US006480214B2

(12) United States Patent
Nishimura et al.

(10) Patent No.: US 6,480,214 B2
(45) Date of Patent: Nov. 12, 2002

(54) PRINT, PRINTING METHOD, PRINTER, AND IMAGE READING METHOD AND DEVICE CAPABLE OF INHIBITING IMPROPER REPRODUCTION

(75) Inventors: Tomoyoshi Nishimura, Saitama (JP); Takeshi Fujishiro, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 44 days.

(21) Appl. No.: 09/753,683

(22) Filed: Jan. 4, 2001

(65) Prior Publication Data

US 2001/0007466 A1 Jul. 12, 2001

(30) Foreign Application Priority Data

Jan. 7, 2000 (JP) ..... 2000-001926

(51) Int. Cl.[7] ..... B41J 2/315; B41J 2/32
(52) U.S. Cl. ..... 347/175; 347/171
(58) Field of Search ..... 347/172, 171, 347/175; 400/120.01

(56) References Cited

U.S. PATENT DOCUMENTS 5,369,419 A * 11/1994 Stephenson et al. ..... 347/171
5,752,152 A 5/1998 Gasper et al. ..... 399/366
5,774,162 A * 6/1998 Fukuda ..... 347/175
6,164,849 A * 12/2000 Koyama ..... 400/120.01
6,297,840 B1 * 10/2001 Inana ..... 347/175

FOREIGN PATENT DOCUMENTS

JP 11-245432 * 9/1999
JP 2001-225498 * 8/2001
WO 94/01288 1/1994 ..... B42D/15/00

* cited by examiner

*Primary Examiner*—Huan Tran
(74) *Attorney, Agent, or Firm*—Sughrue Mion, PLLC

(57) ABSTRACT

A thermosensitive recording sheet includes a support and three thermosensitive coloring layers overlaid on the support. A print is produced by image recording to the recording sheet. A colorless gloss indicia is recorded by thermal recording, and discernible according to a glossiness difference. In a preferred embodiment, an image reading device comprises an image reader for reading an image from an original. A glossmeter unit measures glossiness of respectively unit areas in the original. An arithmetic operation unit obtains an average glossiness of the glossiness of respectively the unit areas. An indicia discriminator checks existence of a gloss indicia according to a glossiness difference between the glossiness of respectively the unit areas and the average glossiness. A controller allows the image reader to operate if the gloss indicia lacks, and generates an alarm signal if the gloss indicia exists.

29 Claims, 10 Drawing Sheets

PRINT, PRINTING METHOD, PRINTER, AND IMAGE READING METHOD AND DEVICE CAPABLE OF INHIBITING IMPROPER REPRODUCTION

BACKGROUND OF THE INVENTION

1. Field of the Invention

The present invention relates to a print, a printing method, a printer, and an image reading method and device capable of inhibiting improper reproduction. More particularly, the present invention relates to a print, a printing method, a printer, and an image reading method and device in which indicia for security against reproduction can be recorded without lowering image quality.

2. Description Related to the Prior Art

As digital copying device have been developed today, it is possible to produce a duplicated material easily with very high precision in a form that human eyes cannot discern from an original image sheet. There have been dealers who produce and sell unauthorized copies by duplicating original image sheets. It is necessary to prevent the unwanted duplication.

U.S. Pat. No. 5,752,152 (corresponding to JP-A 09-226228) discloses a technique in which micro dots are formed in an original image sheet in a form invisible to human eyes, and duplication of the original image sheet is inhibited when a copying machine detects the micro dots. However, a duplicated material cannot be discerned from the original image sheet by human eyes. It is impossible to prevent illegal trade of the duplicated material.

WO 94/01288 (corresponding to JP-A 503899) discloses a protection sheet, which is attached to a print in such a manner that an image in the print can be viewed if inclined under daylight, but cannot be retrieved by a scanner or the like for reading in the vertical direction. With the protection sheet attached to the print, illegal duplication of the print is prevented even if no specialized copying machine is used. However, there is a problem in that the attachment of the protection sheet to the print lowers the quality of the print or definition of its image. Furthermore, an additional process of attaching the protection sheet is required. The print cannot be obtained easily in the form protected from duplication.

SUMMARY OF THE INVENTION

In view of the foregoing problems, an object of the present invention is to provide a print, a printing method, a printer, and an image reading method and device in which indicia for security against reproduction can be recorded without lowering image quality.

In order to achieve the above and other objects and advantages of this invention, a print is produced by image recording to thermosensitive recording material including a support and at least one thermosensitive coloring layer overlaid on the support. At least one colorless gloss indicia is recorded by thermal recording, and discernible according to a glossiness difference.

In a preferred embodiment, the recording material further includes a protective layer overlaid on the coloring layer. The gloss indicia is thermally recorded to the protective layer.

The recording material is color thermosensitive recording material, and the at least one coloring layer comprises first, second and third coloring layers, overlaid on the support in sequence on one another, colorable in predetermined colors.

The print comprises an effective printing region adapted to the image recording. A margin region is disposed outside the effective printing region. The gloss indicia is disposed in the margin region.

The print comprises an effective printing region adapted to the image recording. The gloss indicia is disposed in the effective printing region and close to an end thereof.

According to one aspect of the invention, a printer is provided for image recording to thermosensitive recording material including a support, at least one thermosensitive coloring layer overlaid on the support, and a protective layer overlaid on the coloring layer. A thermal head is provided for thermal recording to the coloring layer. A controller controls the thermal head, and thermally records at least one colorless gloss indicia by heating the protective layer at a predetermined temperature during or after the thermal recording to the coloring layer, the predetermined temperature being lower than a temperature at which the coloring layer is colored and higher than a glass transition point of the protective layer, the gloss indicia being discernible according to a glossiness difference.

The recording material is color thermosensitive recording material, the at least one coloring layer comprises first, second and third coloring layers, overlaid on the support in sequence on one another, colorable in predetermined colors, and the second and third coloring layers have fixability to electromagnetic rays. The thermal head effects the thermal recording to the third, second and first coloring layers in sequence. Furthermore, a fixer fixes the third coloring layer after the thermal recording to the third coloring layer and fixes the second coloring layer after the thermal recording to the second coloring layer by use of the electromagnetic rays. The predetermined temperature is lower than a temperature at which the first coloring layer is colored.

According to another aspect of the invention, an image reading device comprises an image reader for reading an image from an original. A glossmeter unit measures glossiness of respectively unit areas in the original. An arithmetic operation unit obtains an average glossiness of the glossiness of respectively the unit areas. An indicia discriminator checks existence of a gloss indicia according to a glossiness difference between the glossiness of respectively the unit areas and the average glossiness. A controller allows the image reader to operate if the gloss indicia lacks, and generates an alarm signal if the gloss indicia exists.

The alarm signal is adapted to disable the image reader from operating or from outputting data.

Furthermore, a moving mechanism moves one of the original and the glossmeter unit relative to a remaining one thereof in a sub scan direction. The glossmeter unit includes a light source for applying inspection light to the original. A glossiness sensor includes plural photo receptor elements arranged in at least one array in a main scan direction crosswise to the sub scan direction, for generating information of the glossiness of respectively the unit areas by detecting the inspection light reflected by the original.

The light source and the glossiness sensor are so disposed that the inspection light is incident upon the original at an incidence angle $\theta 1$ and reflected by the original at a reflection angle $\theta 2$, and satisfy a condition of:

$$\theta 1 = \theta 2 \leqq 60^\circ.$$

The light source and the glossiness sensor are combined in a single unit.

The image reader reads the image in a line-shaped reading region extending in the main scan direction in the original.

The moving mechanism further moves the image reader with the light source and the glossiness sensor.

According to still another aspect of the invention, a printer is provided. An image reader reads an image from an original to obtain image data. An image forming unit forms an image according to the image data. A glossmeter unit measures glossiness of respectively unit areas in the original. An arithmetic operation unit obtains an average glossiness of the glossiness of respectively the unit areas. An indicia discriminator checks existence of a gloss indicia according to a glossiness difference between the glossiness of respectively the unit areas and the average glossiness. A controller allows the image forming unit to operate if the gloss indicia lacks, and generates an alarm signal if the gloss indicia exists.

The alarm signal is adapted to disable the image reader and/or the image forming unit.

The glossmeter unit operates while or before the image reader operates.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
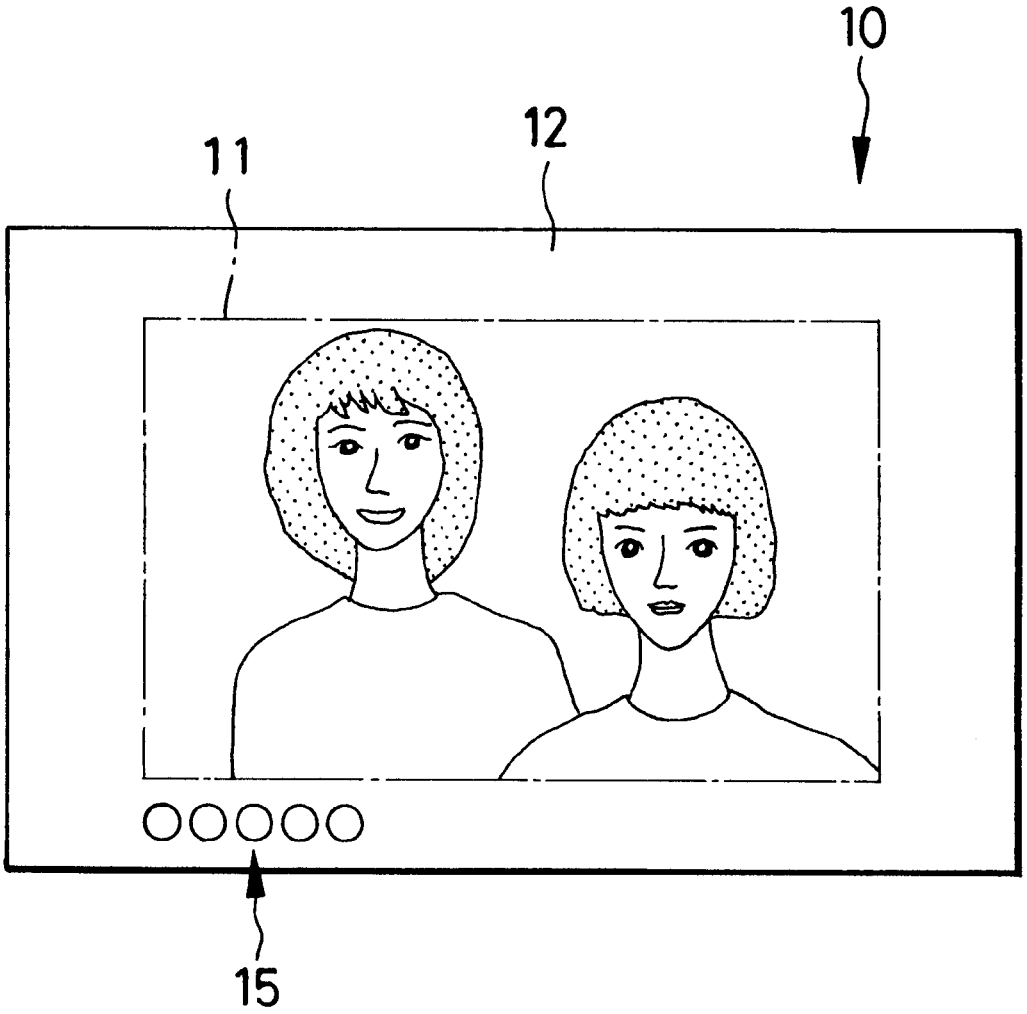
FIG. 1 is a plan illustrating a print provided with a gloss indicia according to the present invention.

In FIG. 1, a color print 10 of the present invention is illustrated. An effective printing region 11 is defined in the center of the color print 10, and provided with a full-color image created by thermal recording operation. A margin region 12 is disposed around the effective printing region 11. At least one gloss indicia 15 or security indicia is disposed in the margin region 12. The gloss indicia 15 represents information that the color print 10 is an original product and duplication is inhibited. The gloss indicia 15 is defined by a difference in gloss of the surface of the color print 10. In the present embodiment, the region inside the gloss indicia 15 has higher gloss than the region thereabout. Note that the gloss indicia 15 may have any suitable shape such as letter, symbols, signs, bars of a bar code, or the like, or a combination of some of those. Also, it is possible that the gloss indicia 15 may represent information of an owner of the copyright of the color print 10 in compliance with the copyright law.

Figure 2:
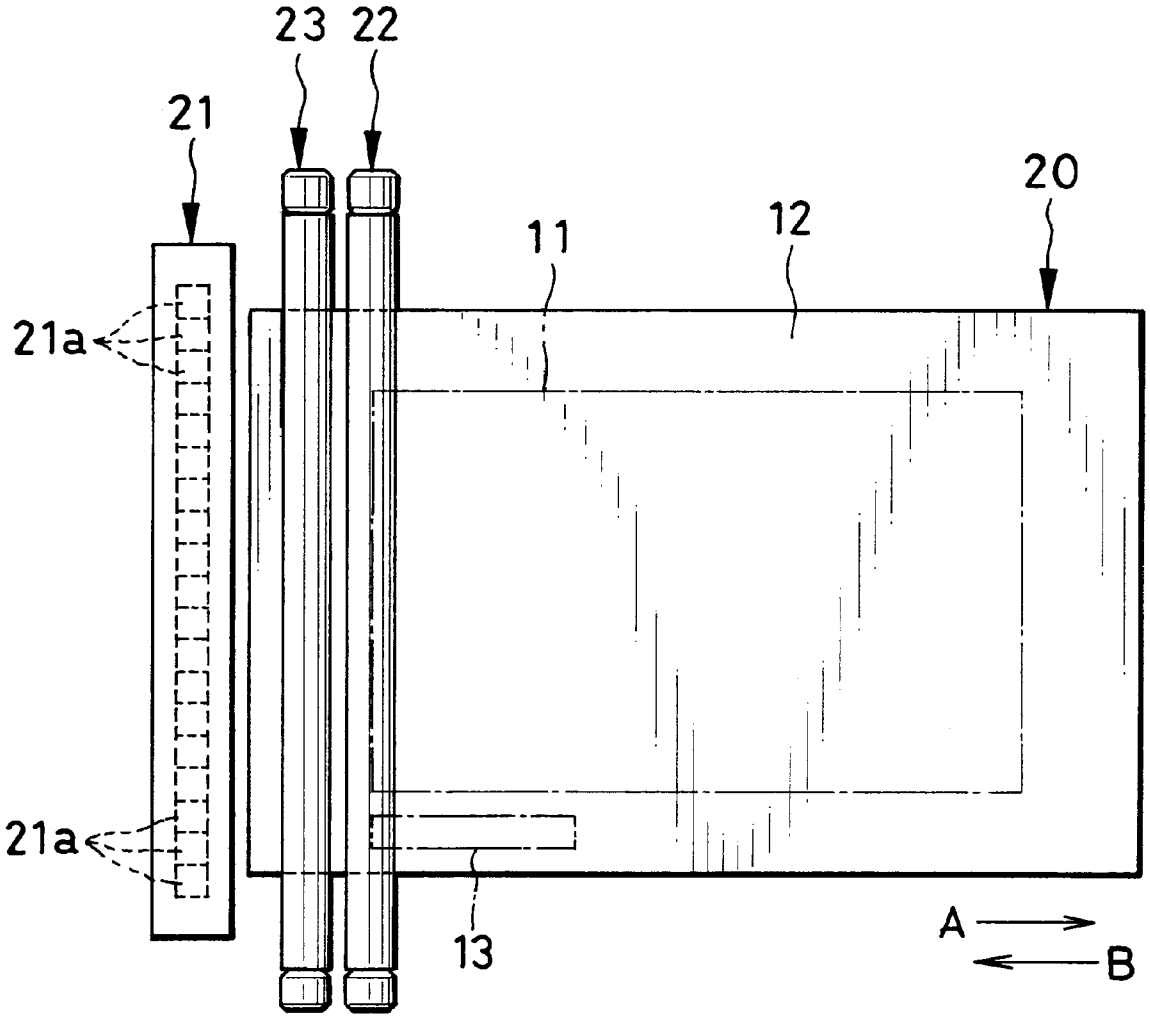
FIG. 2 is a plan illustrating a principal section of a color thermal printer with the print.

In FIG. 2, a color thermal printer for producing the color print 10 is depicted. A color thermosensitive recording sheet 20 as recording material is nipped by feeding rollers (not shown), and fed in a forward direction A and a backward direction B.

There are a thermal head 21 and yellow and magenta fixers 22 and 23 disposed in a feeding path for the recording sheet 20. The thermal head 21 records an image to the recording sheet 20 by application of pressure and heat. An array of plural heating elements 21a constitutes the thermal head 21, and generates heat energy according to color density of dots to be recorded thermally. The yellow fixer 22 has an ultraviolet lamp for emitting ultraviolet rays of which a peak of a wavelength is 420 nm. The magenta fixer 23 has an ultraviolet lamp for emitting ultraviolet rays of which a peak of a wavelength is 365 nm. Sizes of the thermal head 21 and the yellow and magenta fixers 22 and 23 are greater than a width of the recording sheet 20 in a direction crosswise to feeding.

Figure 3:
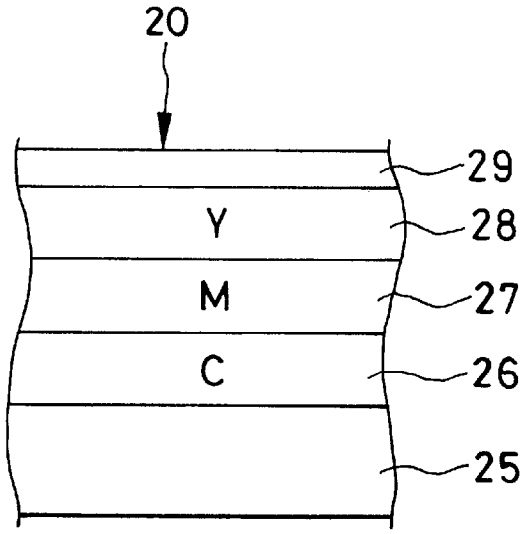
FIG. 3 is an explanatory view in section, illustrating a structure of layers in a thermosensitive coloring sheet.

In FIG. 3, the recording sheet 20 includes a support 25 and cyan, magenta and yellow thermosensitive coloring layers 26, 27 and 28 overlaid on one another in sequence. A protective layer 29 is overlaid on the yellow coloring layer 28. There are intermediate layers (not shown) disposed between the three coloring layers 26–28 and the protective layer 29. A direction of thermal recording to the three coloring layers 26–28 is toward the recording sheet 20. The yellow coloring layer 28 has such a characteristic that its coloring ability is destroyed upon application of visible violet rays of a wavelength of approximately 420 nm. The magenta coloring layer 27 has such a characteristic that its coloring ability is destroyed upon application of near ultraviolet rays of a wavelength of approximately 365 nm. The protective layer 29 is formed from polyvinyl alcohol (PVA), and has a glass transition point of approximately 70 degrees Celsius.

Figure 4:
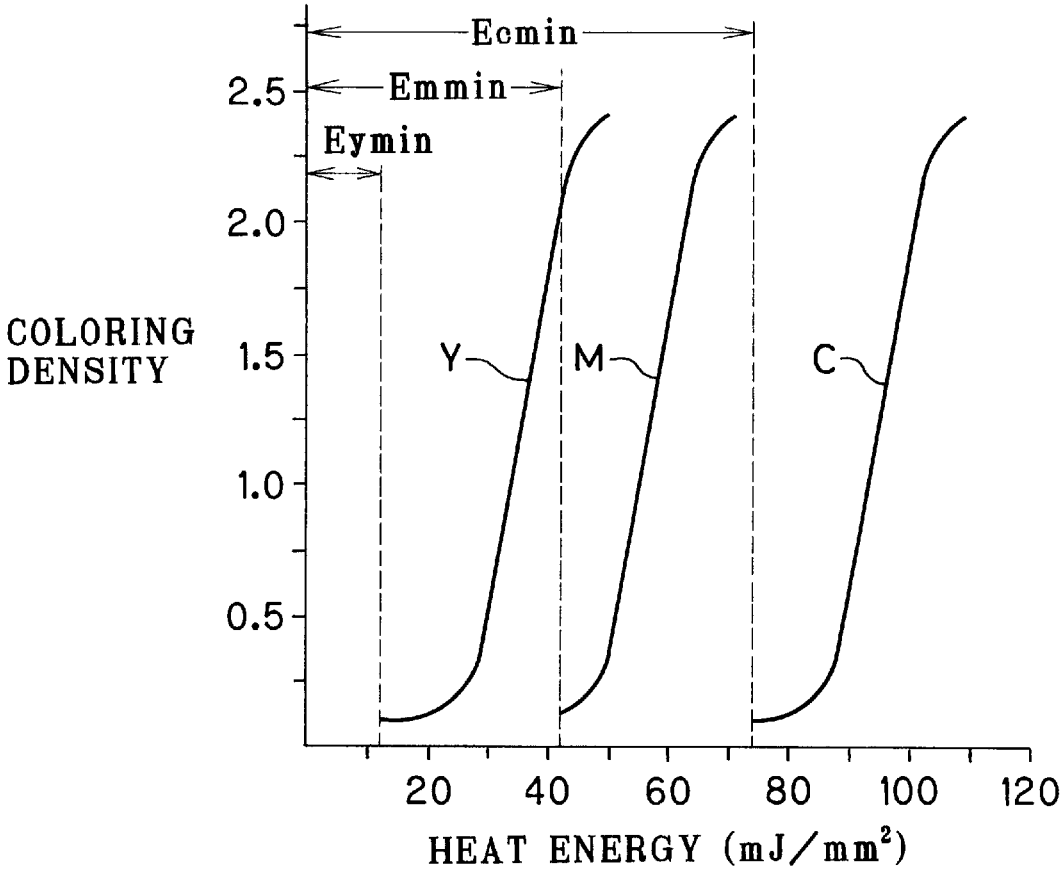
FIG. 4 is a graph illustrating coloring characteristics of coloring layers in the recording sheet.

FIG. 4 is a graph illustrating coloring characteristics of the three coloring layers 26–28. Signs Y, M and C represent respectively the yellow, magenta and cyan coloring layers 28, 27 and 26. A horizontal axis of the graph is taken for heat energy generated by the heating elements 21*a* in the thermal head 21. The yellow coloring layer 28 is colored by application of the lowest heat energy because of the highest heat sensitivity. The cyan coloring layer 26 is colored by application of the highest heat energy because of the lowest heat sensitivity. Of course, higher density in each color to be developed requires application of higher heat energy.

Figure 5:
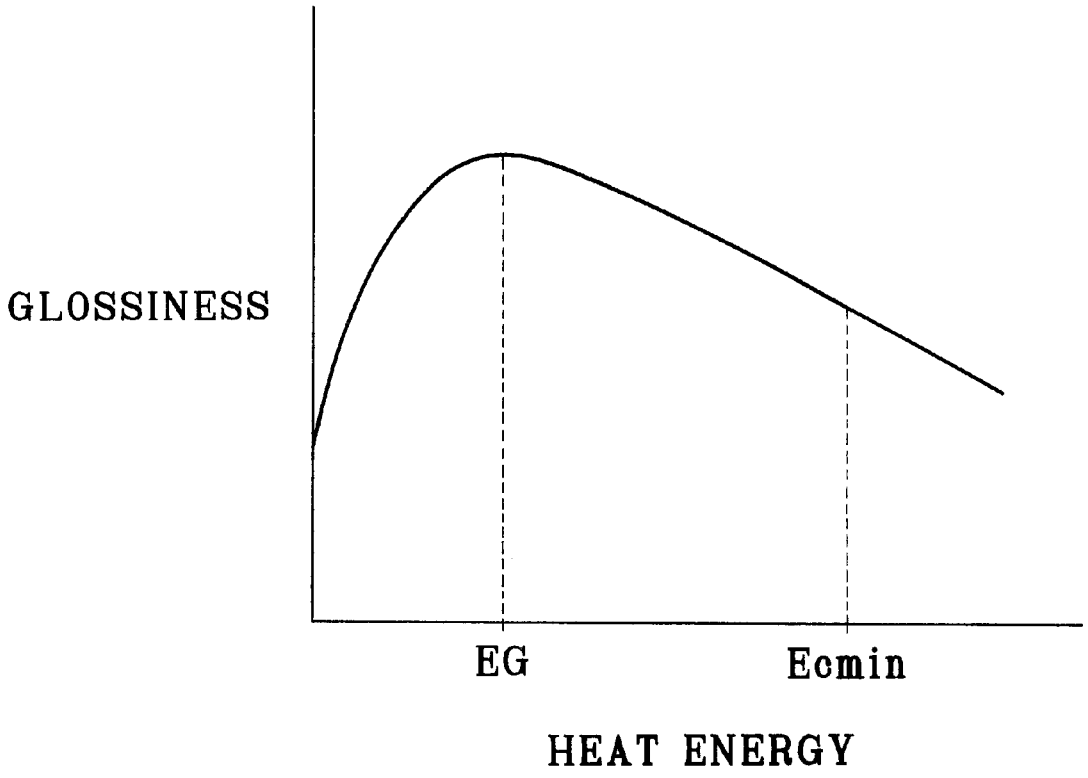
FIG. 5 is a graph illustrating a relationship between glossiness and heat energy applied to the recording sheet.

When the recording sheet 20 is heated by the thermal head 21, a surface of the protective layer 29 is smoothed, and provided with higher gloss. In FIG. 5, gloss of the recording sheet 20 is low according to smallness in heat energy applied thereto. The gloss increases according to an increase in the heat energy. If the heat energy comes equal to or higher than a threshold energy EG, the gloss decreases according to an increase in the heat energy.

In the printer, a full-color image is printed to the recording sheet 20 according to three-color frame-sequential recording. The recording operation causes the image to lie in the effective printing region 11, and creates the margin region 12 about the effective printing region 11. See FIG. 2. Also, an indicia recording region 13 is disposed in the margin region 12 and positioned in a range covered by the thermal head 21. The gloss indicia 15 is recorded into the indicia recording region 13.

Figure 6:
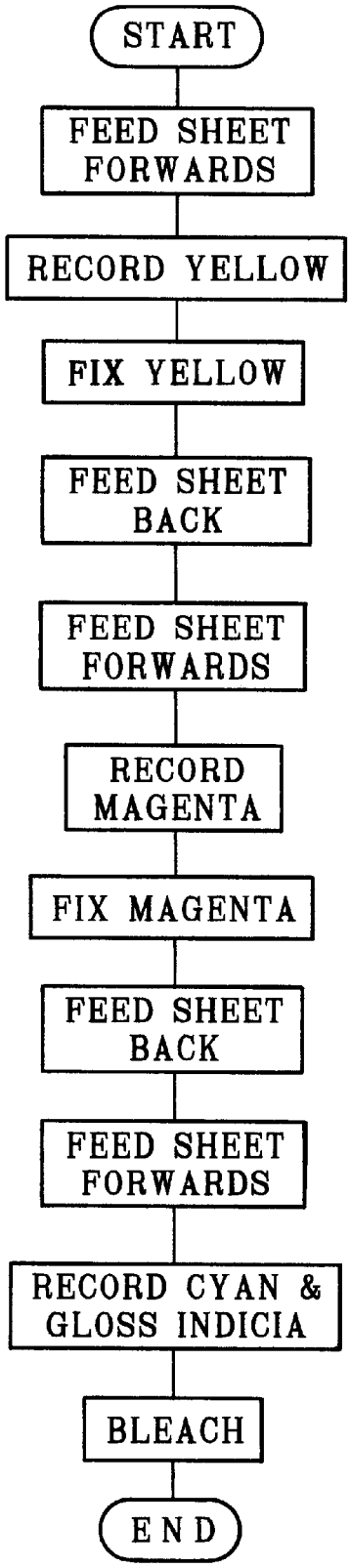
FIG. 6 is a flow chart illustrating a printing operation of the printer.

FIG. 6 is a flow chart illustrating a process of producing the color print 10 in the printer. While the recording sheet 20 is fed in the forward direction A for the first time, the thermal head 21 records a yellow image to the effective printing region 11 thermally. During the yellow recording, the yellow fixer 22 is driven. The yellow coloring layer 28 is optically fixed immediately after the recording.

During the feeding in the forward direction A for the second time, a magenta color is recorded to the effective printing region 11 thermally. The magenta fixer 23 is driven during the magenta recording, to fix the magenta coloring layer 27 immediately after being recorded.

During the feeding in the forward direction A for the third time, a cyan color is recorded to the effective printing region 11 thermally. Also, the gloss indicia 15 is recorded thermally to the indicia recording region 13 at the same time. The magenta fixer 23 is driven during the magenta recording, to bleach unrecorded regions that have been yellowish.

The gloss indicia 15 is thermally recorded by heat energy EG by which the recording sheet 20 comes to have the highest glossiness. See FIG. 5. Note that it is sufficient for the gloss indicia 15 to have a difference in glossiness than a portion about the gloss indicia 15. Thus, heat energy E for recording the gloss indicia 15 can be in a range of:

$$Eymin \leqq E < Ecmin$$

where Eymin is heat energy sufficient for coloring the yellow coloring layer 28 at the lowest density, and Ecmin is heat energy sufficient for coloring the cyan coloring layer 26 at the lowest density. See FIG. 4. The gloss indicia 15 recorded to the cyan coloring layer 26 has higher glossiness than the margin region 12 without development of color.

The cyan coloring layer 26 is colored upon application of heat energy of at least approximately 80 $mJ/mM^2$, and does not have fixability because not colored in an ordinary condition of preservation. See FIG. 4. The recording sheet 20 is ejected from the printer as the color print 10 finally after recording of the cyan color and the gloss indicia 15.

Consequently, the gloss indicia 15 does not have a conspicuous appearance and does not lower quality of the color print 10, because only the difference in glossiness determines the gloss indicia 15. Should the color print 10 be duplicated, the gloss indicia 15 is not detected by a reader such as a scanner in the duplicator, and not copied on to a print. This makes it possible to detect whether a color print is an original or a copy according to existence or lack of the gloss indicia 15.

Furthermore, it is possible for the printer to have an auxiliary thermal head specified for recording the gloss indicia 15 in addition to the thermal head 21.

Figure 7:
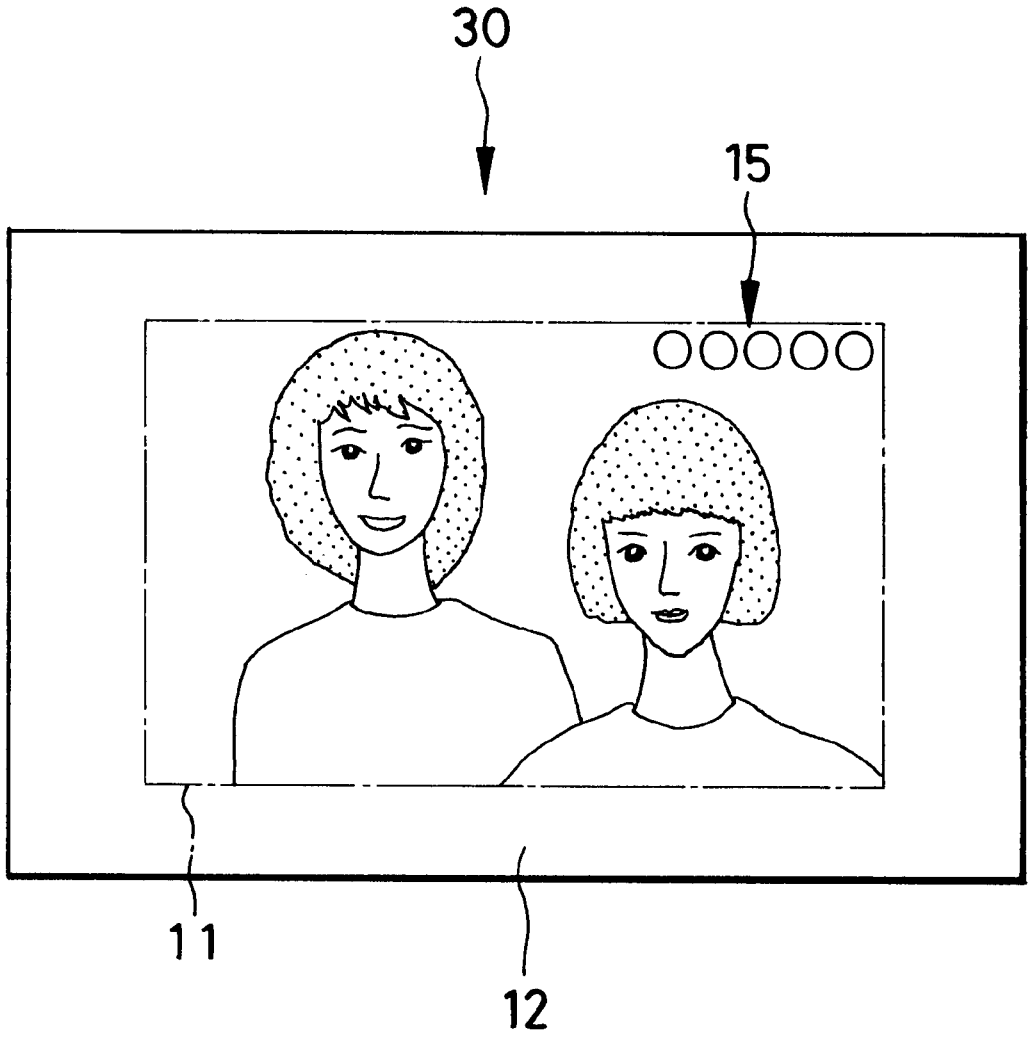
FIG. 7 is a plan illustrating another preferred print in which a gloss indicia is recorded inside an effective recording region.
Figure 8:
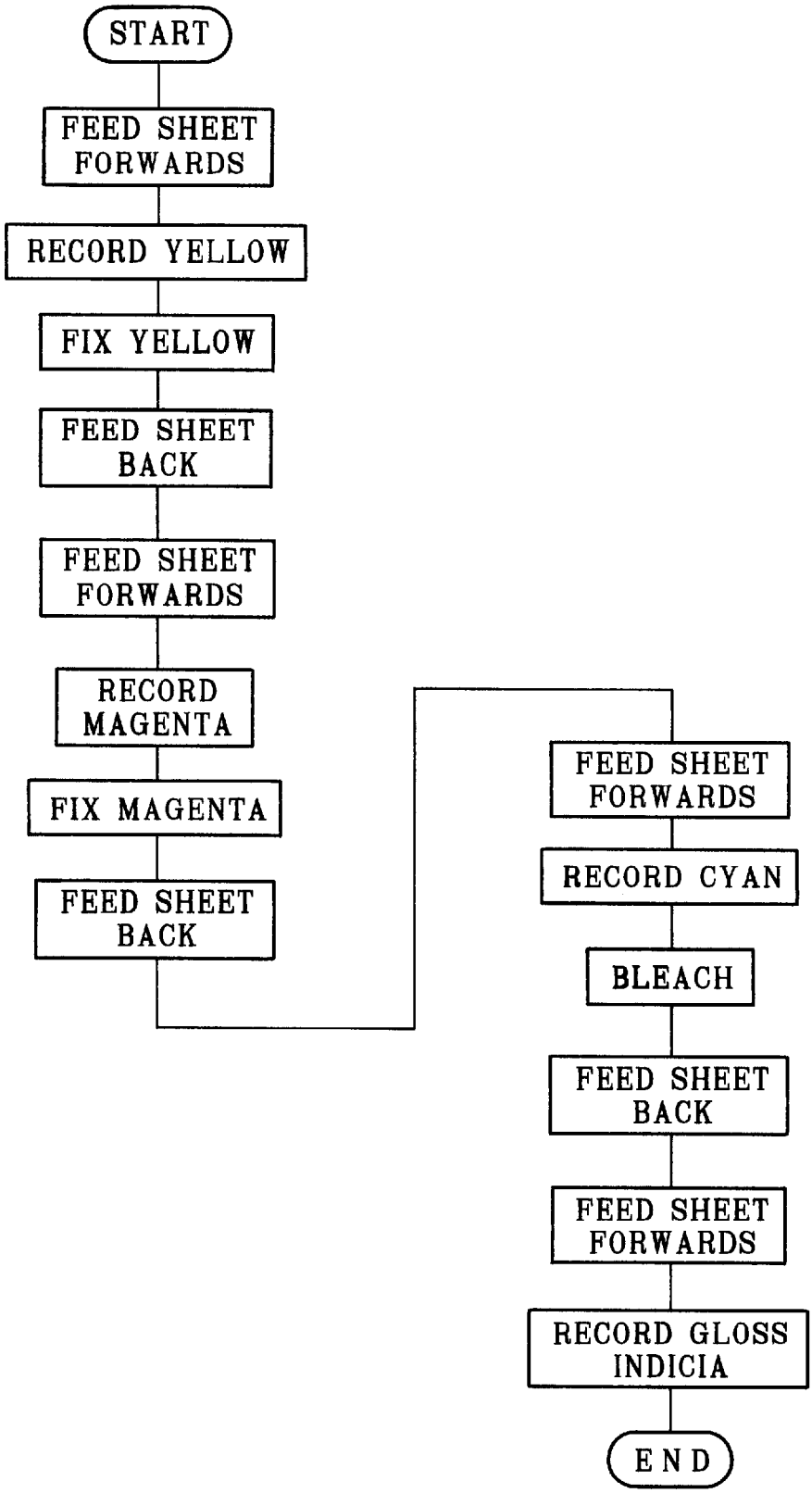
FIG. 8 is a flow chart illustrating a printing operation of producing the print of FIG. 7.

In the above embodiment, the gloss indicia 15 is recorded to the margin region 12. Another preferred embodiment is depicted in FIG. 7, in which a color print 30 has the gloss indicia 15 recorded to the effective printing region 11. In FIG. 8, the recording sheet 20 is fed backwards after recording of yellow, magenta and cyan colors, and then fed forwards. In the forward feeding, the gloss indicia 15 can be recorded thermally. Also, in this embodiment, the gloss indicia 15 is recorded with heat energy E satisfying the condition of:

$$Eymin \leqq E < Ecmin$$

and preferably with the heat energy EG. It is possible in the present embodiment that the heating elements 21*a* may have a size not sufficient for the width of the recording sheet 20 but sufficient for a width of the effective printing region 11.

In the above embodiment, the gloss indicia 15 has higher glossiness than the region thereabout. However, the gloss indicia 15 may be so defined that a region inside the same may have lower glossiness than the region thereabout. For this construction, heat energy is applied to the region outside the gloss indicia 15 after the cyan recording, for smoothing processing to develop gloss. Thus, a difference in the gloss occurs between the inside and outside of the gloss indicia 15. The energy E for the smoothing processing can be in a range of $Eymin \leqq E < Ecmin$, and desirably EG. Note that a position for forming the gloss indicia 15 with the lower gloss may be inside or outside the effective printing region 11.

When the recording sheet 20 is subjected to thermal recording, heated portions become recessed slightly with reference to portions about those. Also, contours of an image or contours of the heated portions become protruded. It is known in the art that the gloss changes with the degrees of being recessed or protruded. Consequently, processing of edge enhancement can be preferably used for a contour of the gloss indicia 15 to raise the amount of being recessed or protruded. The glossiness difference between the gloss indicia 15 and the peripheral region becomes the higher, to increase conspicuousness of the gloss indicia 15. In this case, the gloss indicia 15 is still colorless, and does not lower the quality of the print.

In the above embodiment, the print 10 is a full-color print. However, the print 10 with the protective layer 29 may be monochromatic, or may be a print with two or more colors.

In the thermal printer, ultraviolet rays for fixation are applied to the recording sheet 20 still after the cyan recording for the purpose of bleaching the recording sheet 20. It is known in the art that the margin region 12 becomes yellowish when heated after being bleached. Therefore, an indicia for security can be a yellowish indicia, which can be formed by applying heat energy after the cyan recording and bleaching, the heat energy being short of that required for the lowest cyan density. The yellowish security indicia should be recorded to the margin region 12 outside the effective printing region 11. The yellowish security indicia does not influence to the quality of the color print 10 because the density of the yellowish color is extremely low. Also, the yellowish security indicia can be easily recognized by human eyes.

Figure 9:
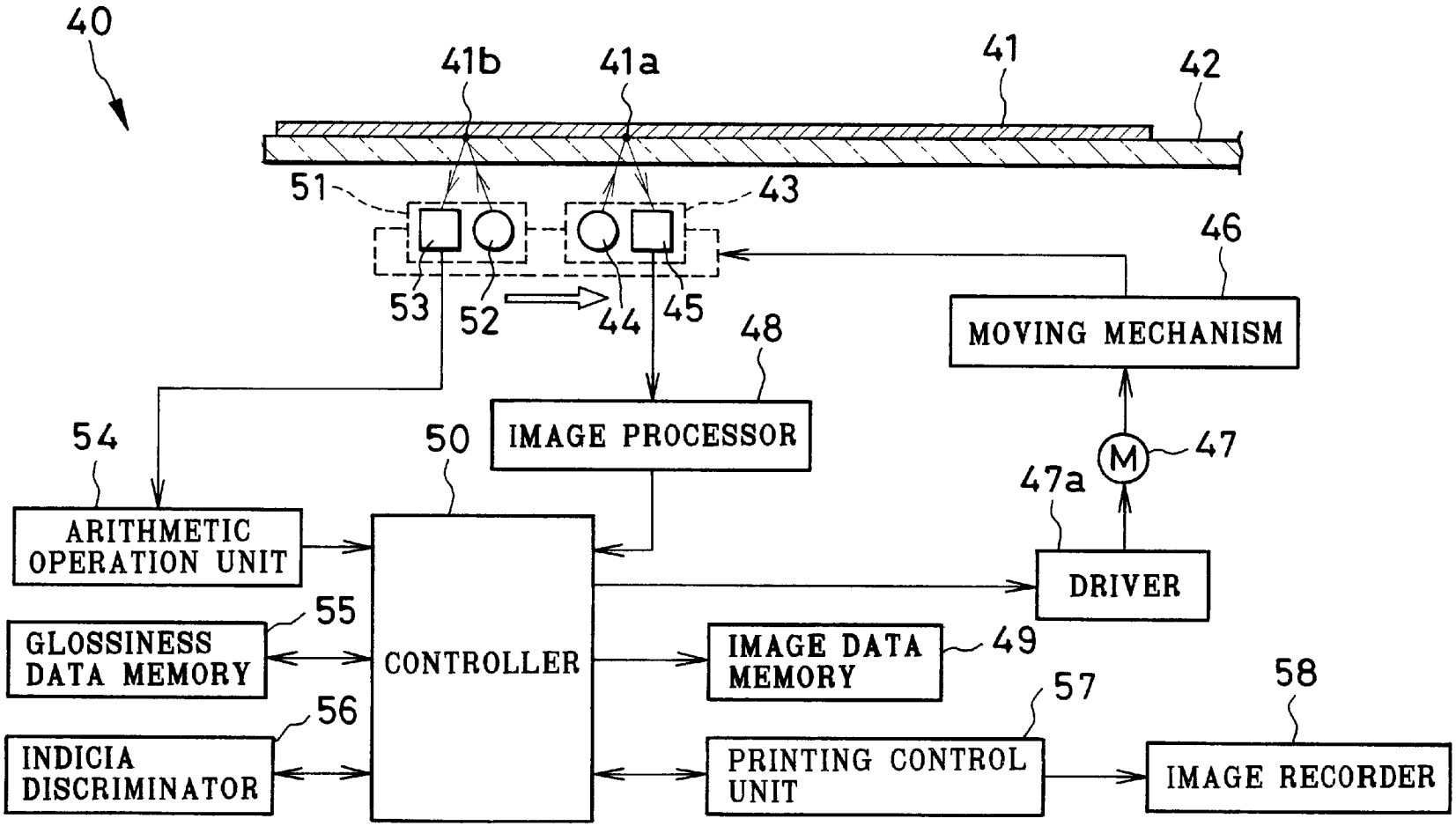
FIG. 9 is an explanatory view in diagram and section, illustrating an image reading device of the invention.

In FIGS. 9–12, a printer 40 as image forming apparatus is described. The printer 40 reads an image from an original sheet 41 and prints or copies the image to a sheet. If the original sheet 41 has the gloss indicia 15, printing is inhibited. In FIG. 9, a transparent stage plate 42 is provided in the printer 40, and supports the original sheet 41 in an orientation with its image surface directed downwards. An image reader 43 and a glossmeter unit 51 are disposed under the transparent stage plate 42.

The image reader 43 is a single unit including a light source 44 and an image reading sensor 45. The light source 44 applies illuminating light of a uniform manner to a line-shaped reading region 41a extending in the original sheet 41. See FIG. 10. The image reading sensor 45 consists of a CCD line sensor, reads an image in the line-shaped reading region 41*a* being illuminated, and outputs an image signal. A moving mechanism 46 moves the image reader 43 at a constant speed in a sub scan direction that is perpendicular to the length direction of the light source 44 and the image reading sensor 45. In synchronism with this, the image reading sensor 45 reads the image in the original sheet 41 line after line. A motor 47 drives the moving mechanism 46. A controller 50 controls a driver 47*a* to drive the motor 47 for rotation.

An image processor 48 is connected with the image reading sensor 45, and converts an output from the image reading sensor 45 into image data of each of the colors. The controller 50 writes the image data to an image data memory 49.

The glossmeter unit 51 is a single unit including a light source 52 and a glossiness sensor 53. The light source 52 applies white light of a uniform manner to a line-shaped measuring region 41*b* in the original sheet 41. The glossiness sensor 53 receives the light reflected by the line-shaped measuring region 41*b* after emission from the light source 52, and outputs a glossiness signal for each of unit areas according to intensity. The unit areas related to the glossiness sensor 53 are determined as pixels or groups of adjacent pixels. In the present embodiment, the glossiness signal is output for each pixel.

Note that it is possible for the light source 52 to emit inspection light with any different color from white for the purpose of measuring glossiness.

Figure 10:
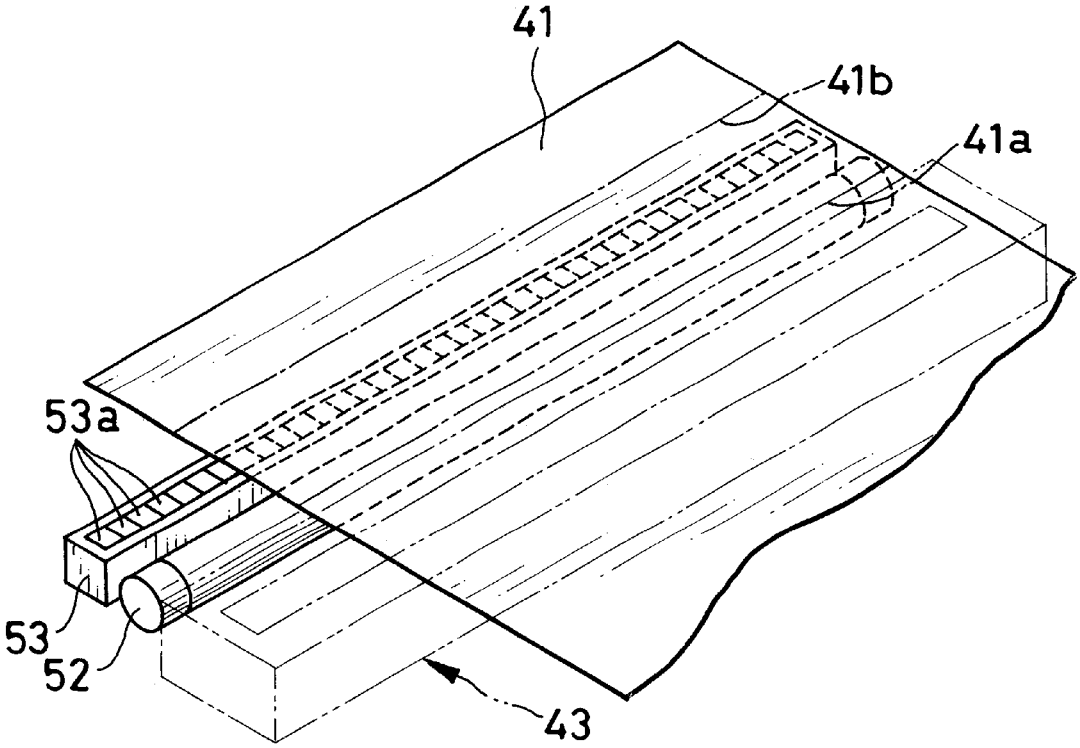
FIG. 10 is a perspective illustrating a principal section of the image reading device.

In FIG. 10, the line-shaped measuring region 41*b* extends in parallel with the line-shaped reading region 41*a* where the image reader 43 reads an image. The glossiness sensor 53 is a line sensor, in which photo receptor elements 53*a* are arranged in an array. The light source 52 extends in parallel with the glossiness sensor 53.

Figure 11:
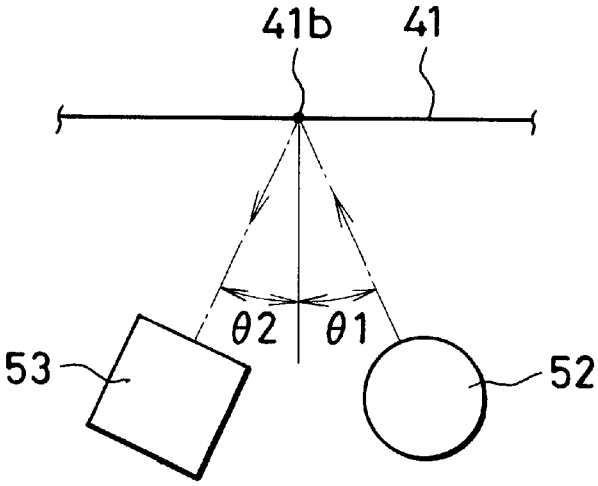
FIG. 11 is an explanatory view illustrating disposition of a light source and glossiness sensor.

In FIG. 11, let θ1 be an incidence angle of the light from the light source 52 to the line-shaped measuring region 41*b* in the original sheet 41. Let θ2 be a reflection angle of the light from the line-shaped measuring region 41*b* to the glossiness sensor 53. The reflection angle θ2 is equal to the incidence angle θ1. Furthermore, the light source 52, the glossiness sensor 53 and the original sheet 41 are so disposed that the incidence angle θ1 and the reflection angle θ2 are 60 degrees or less for the purpose of high efficiency in projecting and receiving the light.

In FIG. 9, the glossmeter unit 51 is disposed in parallel with the light source 44 in the image reader 43 and the image reading sensor 45. Also, the glossmeter unit 51 and the image reader 43 are included in a single component. The glossmeter unit 51 is moved together with the image reader 43 in response to rotation of the motor 47. In synchronism with the movement, the glossiness sensor 53 measures glossiness of the surface of the original sheet 41 line after line.

An arithmetic operation unit 54 is provided with a glossiness signal obtained by the glossiness sensor 53 for each of the pixels. The arithmetic operation unit 54 converts the glossiness signal to glossiness data, and sends the glossiness data to the controller 50. The controller 50 writes the glossiness data to a glossiness data memory 55.

An indicia discriminator 56 and a printing control unit 57 are connected with the controller 50. The indicia discriminator 56 calculates average glossiness Ge and glossiness difference ΔG, to detect the gloss indicia 15 as security indicia. At first, glossinesses G of the pixels are read from the glossiness data memory 55. The average glossiness Ge of the glossinesses G is calculated. Then glossiness differences $\Delta G=|G-Ge|$ are obtained according to the glossinesses G of the pixels and the average glossiness Ge. Data of the glossinesses G of the pixels are binarized according to the glossiness differences ΔG, so that pixels are classified into a group with high gloss and a group with low gloss. If the group with high gloss is constituted by pixels adjacent to one another in a form of a region, then it is judged that the gloss indicia 15 exists. Information of the existence of the gloss indicia 15 is sent to the controller 50. Note that a pattern recognition may be used to check a shape of the indicia portion detected by the indicia discriminator 56 to raise precision of discriminating existence of the gloss indicia 15. The gloss indicia 15 may be discerned according to coincidence with a reference pattern stored previously.

If the gloss indicia 15 exists, the controller 50 does not effect a printing operation as the information of inhibiting duplication is recognized. An alarm signal is generated to signal the information that the duplication is inhibited. If the gloss indicia 15 does not exist, the controller 50 effects the printing operation because of no inhibition of duplication.

Figure 12:
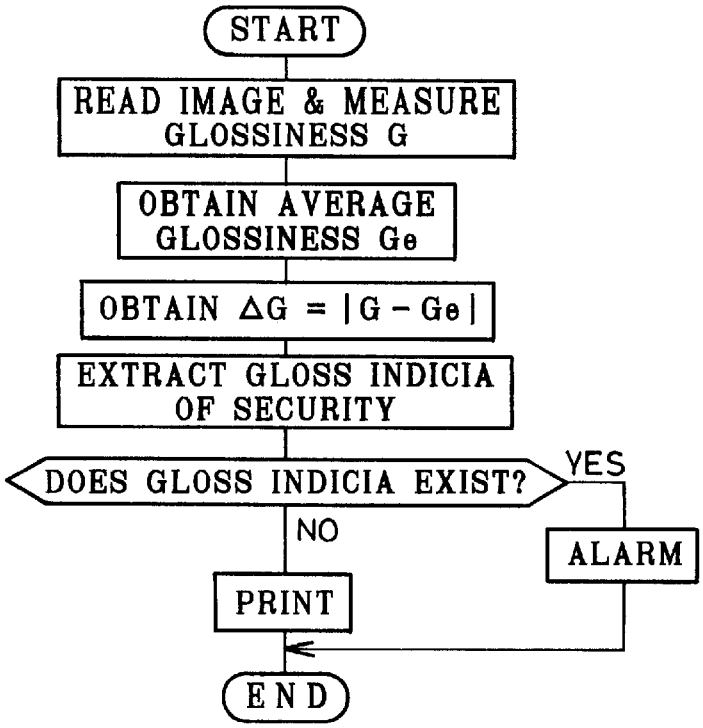
FIG. 12 is a flow chart illustrating operation of image reading.

In FIG. 12, a process of operating the printer 40 is illustrated. When a user places the original sheet 41 on the transparent stage plate 42 and enters a signal of starting copying, then the motor 47 is driven. The image reader 43 and the glossmeter unit 51 are moved by the moving mechanism 46 at a constant speed while opposed properly to the original sheet 41.

In synchronism with movement of the image reader 43 and the glossmeter unit 51, the image reading sensor 45 reads an image in the original sheet 41 one line after another. An output signal from the image reading sensor 45 is converted by the image processor 48 to image data of each color. The image data is written to the image data memory 49 by the controller 50. At the same time, the glossiness sensor 53 measures surface glossiness of the original sheet 41 line after line. The glossiness sensor 53 outputs the glossiness signal, which is converted by the arithmetic operation unit 54 to glossiness data. The controller 50 writes the glossiness data to the glossiness data memory 55 for the respective pixels.

When image reading and gloss measurement are completed, the indicia discriminator 56 discerns existence or lack of the gloss indicia 15. At first, glossinesses G of the pixels are read from the glossiness data memory 55, to calculate average glossiness Ge. Then glossiness differences ΔG are calculated by subtraction between the average glossiness Ge and the glossinesses G of the pixels. The glossinesses G of the pixels are binarized by means of the glossiness differences ΔG, to classify the pixels into groups of the inside and outside of the gloss indicia 15. If the pixels in the group of the inside of the gloss indicia 15 are detected adjacent with one another, then it is judged that the gloss indicia 15 exists. If not, then it is judged that the gloss indicia 15 does not exist.

In the color print 10, the gloss indicia 15 has higher glossiness or lower glossiness than the peripheral region in an easily recognizable manner with human eyes. If one places the color print 10 in the printer 40 with intention for copying, the indicia discriminator 56 detects existence of the gloss indicia 15 because of the great glossiness difference between the gloss indicia 15 and the peripheral region. The printing is inhibited. This is effective in preventing illegal duplication of the color print 10.

In the above embodiment, the light source 52 has a straight shape for illuminating the line-shaped measuring region 41*b*. However, an array of light-emitting diodes (LEDs) may be disposed in the main scan direction that is perpendicular to the feeding direction A or B or sub scan direction. In the above embodiment, the glossinesses are measured per each of the pixels. However, a certain number of plural pixels may be grouped as a unit for measurement of glossiness.

Furthermore, the light source 52 may be a surface light source for illumination with an area. It is sufficient that the glossiness sensor 53 detects the reflected light only in a narrow region of a line shape in a manner irrespective of the form of the light source 52.

Figure 13:
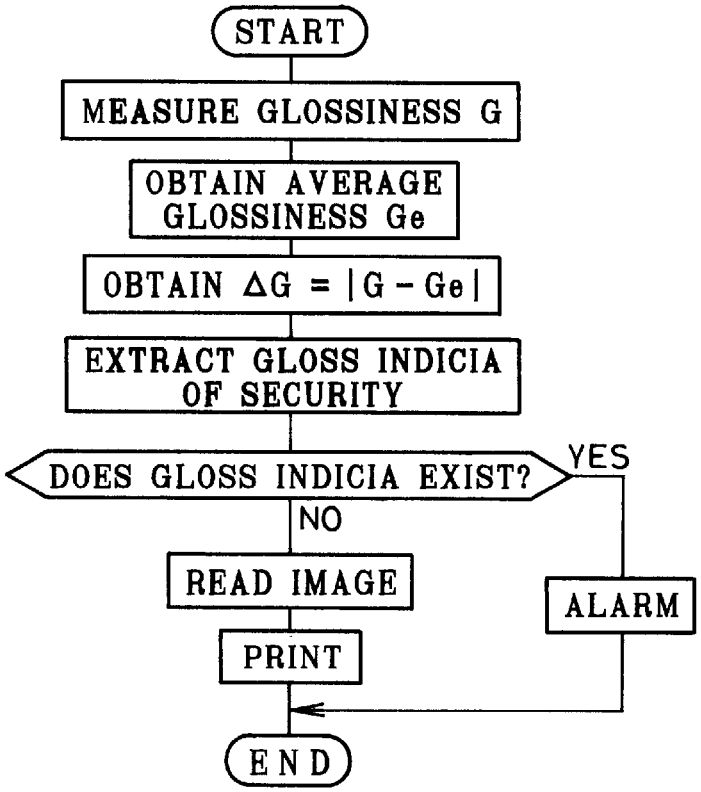
FIG. 13 is a flow chart illustrating operation of image reading according to another preferred image reading device.

In FIG. 13, another preferred embodiment is depicted. At the time of copying, the glossiness is measured at first to check existence of the gloss indicia 15. If the gloss indicia 15 does not exist, then an image is read in the printer for the purpose of printing.

In the above embodiment, an image forming unit 58 or image recorder for printing is included in the printer 40 and controlled by the printing control unit 57. However, the present invention is applicable to an image reading device that does not have the image forming unit 58 or the printing control unit 57.

The image forming unit 58 may be a device according to any type of image forming techniques, for example, thermal recording type, electrophotographic type, video printing type for use with photosensitive material, and the like.

In the above embodiment, the gloss indicia 15 is detected to inhibit printing upon recognition of impropriety for duplication. However, the present invention is applicable to operation in which avoiding reproduction with fidelity to the original. Upon detection of the gloss indicia 15, it is possible automatically to modify an image to be printed without similarity to the original. For example, a fogged image may be printed. An additional image of patterns of lines may be overlapped in the printed image.

Furthermore, an alarm signal may be generated upon detecting the gloss indicia 15, such as visible information in a display panel, or acoustic information through a buzzer or loud speaker. Also, a power source for the printer or image reading device may be forcibly turned off in response to detecting the gloss indicia 15.

The present invention is also applicable to a device for inspecting the original sheet 41, the device having the glossmeter unit 51 and the controller 50 without the image reader 43 or the image forming unit 58.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A print produced by image recording to thermosensitive recording material including a support and at least one thermosensitive coloring layer overlaid on said support, said print comprising:

at least one colorless gloss indicia, recorded by thermal recording, and discernible according to a glossiness difference; and wherein said colorless gloss indicia represents information of an owner of said print.

2. A print as defined in claim 1, wherein said recording material further includes a protective layer overlaid on said coloring layer;

said gloss indicia is thermally recorded to said protective layer.

3. A print as defined in claim 2, wherein said recording material is color thermosensitive recording material, and said at least one coloring layer comprises first, second and third coloring layers, overlaid on said support in sequence on one another, colorable in predetermined colors.

4. A print produced by image recording to a color thermosensitive recording material, the color thermosensitive recording material including a support, first, second and third coloring layers overlaid on said support, in sequence on one another and colorable in predetermined colors, and a protective layer overlaid on said coloring layers, said print comprising:

at least one colorless gloss indicia, recorded by thermal recording, and discernible according to a glossiness difference;

an effective printing region adapted to said image recording;

a margin region disposed outside said effective printing region;

wherein said colorless gloss indicia is disposed in said margin region; and wherein said colorless gloss indicia is thermally recorded to said protective layer.

5. A print produced by image recording to a color thermosensitive recording material, the color thermosensitive recording material including a support, first, second and third coloring layers overlaid on said support, in sequence on one another and colorable in predetermined colors, and a protective layer overlaid on said coloring layers, said print comprising:

an effective printing region adapted to said image recording;

at least one colorless gloss indicia, recorded by thermal recording, and discernible according to a glossiness difference;

wherein said colorless gloss indicia is disposed in said effective printing region and close to an end thereof; and wherein said colorless gloss indicia is thermally recorded to said protective layer.

6. A printing method of image recording to thermosensitive recording material including a support, at east one thermosensitive coloring layer overlaid on said support, and a protective layer overlaid on said coloring layer, said printing method comprising steps of:

thermally recording to said coloring layer; and during or after said thermal recording step, thermally recording at least one colorless gloss indicia by heating said protective layer at a predetermined temperature, said predetermined temperature being lower than a temperature at which said coloring layer is colored and higher than a glass transition point of said protective layer, said gloss indicia being discernible according to a glossiness difference.

7. A printing method as defined in claim 6, wherein said recording material is color thermosensitive recording material, said at least one coloring layer comprises first, second and third coloring layers, overlaid on said support in sequence on one another, colorable in predetermined colors, and said second and third coloring layers have fixability to electromagnetic rays;

said predetermined temperature is lower than a temperature at which said first coloring layer is colored.

8. A printing method as defined in claim 7, wherein said indicia recording step is during thermal recording to said first coloring layer.

9. A printing method as defined in claim 7, wherein said indicia recording step is after thermal recording to said first coloring layer.

10. A printing method as defined in claim 6, wherein said recording material includes:

an effective printing region adapted to said image recording;

a margin region disposed outside said effective printing region;

wherein said gloss indicia is disposed in said margin region.

11. A printing method as defined in claim 6, wherein said recording material includes an effective printing region adapted to said image recording;

wherein said gloss indicia is disposed in said effective printing region and close to an end thereof.

12. A printer for image recording to thermosensitive recording material including a support, at least one thermosensitive coloring layer overlaid on said support, and a protective layer overlaid on said coloring layer, said printer comprising:

a thermal head for thermal recording to said coloring layer; and a controller for controlling said thermal head, and for thermally recording at least one colorless gloss indicia by heating said protective layer at a predetermined temperature during or after said thermal recording to said coloring layer, said predetermined temperature being lower than a temperature at which said coloring layer is colored and higher than a glass transition point of said protective layer, said gloss indicia being discernible according to a glossiness difference.

13. A printer as defined in claim 12, wherein said recording material is color thermosensitive recording material, said at least one coloring layer comprises first, second and third coloring layers, overlaid on said support in sequence on one another, colorable in predetermined colors, and said second and third coloring layers have fixability to electromagnetic rays;

said thermal head effects said thermal recording to said third, second and first coloring layers in sequence;

further comprising a fixer for fixing said third coloring layer after said thermal recording to said third coloring layer and fixing said second coloring layer after said thermal recording to said second coloring layer by use of said electromagnetic rays;

said predetermined temperature is lower than a temperature at which said first coloring layer is colored.

14. An image reading method comprising steps of:

measuring glossiness of respectively unit areas in an original;

obtaining an average glossiness of said glossiness of respectively said unit areas;

checking existence of a gloss indicia according to a glossiness difference between said glossiness of respectively said unit areas and said average glossiness;

if said gloss indicia lacks, reading an image from said original; and if said gloss indicia exists, generating an alarm signal.

15. An image reading method as defined in claim 14, wherein said alarm signal is adapted to disable reading of said image from said original, or disable outputting of data according said image reading from said original.

16. An image reading method as defined in claim 15, wherein said glossiness measuring step includes:

applying inspection light to said original; and generating information of said glossiness of respectively said unit areas by detecting said inspection light reflected by said original.

17. An image reading method as defined in claim 16, wherein said inspection light is incident upon said original at an incidence angle θ1 and reflected by said original at a reflection angle θ2, and satisfies a condition of:

$$\theta 1=\theta 2 \leqq 60^{\circ}.$$

18. An image reading device comprising:

an image reader for reading an image from an original;

a glossmeter unit for measuring glossiness of respectively unit areas in said original;

an arithmetic operation unit for obtaining an average glossiness of said glossiness of respectively said unit areas;

an indicia discriminator for checking existence of a gloss indicia according to a glossiness difference between said glossiness of respectively said unit areas and said average glossiness; and a controller for allowing said image reader to operate if said gloss indicia lacks, and for generating an alarm signal if said gloss indicia exists.

19. An image reading device as defined in claim 18, wherein said alarm signal is adapted to disable said image reader from operating or from outputting data.

20. An image reading device as defined in claim 19, further comprising a moving mechanism for moving one of said original and said glossmeter unit relative to a remaining one thereof in a sub scan direction;

wherein said glossmeter unit includes:

a light source for applying inspection light to said original; and a glossiness sensor, including plural photo receptor elements arranged in at least one array in a main scan direction crosswise to said sub scan direction, for generating information of said glossiness of respectively said unit areas by detecting said inspection light reflected by said original.

21. An image reading device as defined in claim 20, wherein said light source and said glossiness sensor are so disposed that said inspection light is incident upon said original at an incidence angle θ1 and reflected by said original at a reflection angle θ2, and satisfy a condition of:

$$\theta 1=\theta 2 \leqq 60^{\circ}.$$

22. An image reading device as defined in claim 20, wherein said light source and said glossiness sensor are combined in a single unit.

23. An image reading device as defined in claim 20, wherein said image reader reads said image in a line-shaped reading region extending in said main scan direction in said original;

said moving mechanism further moves said image reader with said light source and said glossiness sensor.

24. A printing method, including steps of reading an image from an original to obtain image data, and forming an image according to said image data, said printing method comprising steps of:

measuring glossiness of respectively unit areas in said original;

obtaining an average glossiness of said glossiness of respectively said unit areas;

checking existence of a gloss indicia according to a glossiness difference between said glossiness of respectively said unit areas and said average glossiness;

if said gloss indicia lacks, enabling said image reading step and said image forming step; and if said gloss indicia exists, generating an alarm signal.

25. A printing method as defined in claim 24, wherein said alarm signal is adapted to disable said image reading step and/or said image forming step.

26. A printing method as defined in claim 24, wherein said glossiness measuring step is during or before said image reading step.

27. A printer comprising:

an image reader for reading an image from an original to obtain image data;

an image forming unit for forming an image according to said image data;

a glossmeter unit for measuring glossiness of respectively unit areas in said original;

an arithmetic operation unit for obtaining an average glossiness of said glossiness of respectively said unit areas;

an indicia discriminator for checking existence of a gloss indicia according to a glossiness difference between said glossiness of respectively said unit areas and said average glossiness; and a controller for allowing said image forming unit to operate if said gloss indicia lacks, and for generating an alarm signal if said gloss indicia exists.

28. A printer as defined in claim 27, wherein said alarm signal is adapted to disable said image reader and/or said image forming unit.

29. A printer as defined in claim 27, wherein said glossmeter unit operates while or before said image reader operates.

* * * * *